US009164428B2

(12) United States Patent
Miyamoto

(10) Patent No.: US 9,164,428 B2
(45) Date of Patent: Oct. 20, 2015

(54) TONER CASE AND IMAGE FORMING APPARATUS

(71) Applicant: KYOCERA DOCUMENT SOLUTIONS INC., Osaka (JP)

(72) Inventor: Teruyuki Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/083,178

(22) Filed: Nov. 18, 2013

(65) Prior Publication Data

US 2014/0140736 A1 May 22, 2014

(30) Foreign Application Priority Data

Nov. 19, 2012 (JP) ..... 2012-253488

(51) Int. Cl.
*G03G 15/08* (2006.01)

(52) U.S. Cl.
CPC ..... *G03G 15/0877* (2013.01); *G03G 15/0879* (2013.01)

(58) Field of Classification Search
USPC ..... 399/258, 263
See application file for complete search history.

(56) References Cited

U.S. PATENT DOCUMENTS 4,724,459 A * 2/1988 Ford ..... 399/344
7,272,346 B2 * 9/2007 Ito ..... 399/263
2009/0232548 A1 * 9/2009 d'Entrecasteaux ..... 399/120
2011/0293333 A1 * 12/2011 Shima ..... 399/258
2011/0305485 A1 * 12/2011 Oshikawa et al. ..... 399/258
2012/0039634 A1 * 2/2012 Takeshita ..... 399/258
2012/0328336 A1 * 12/2012 Ota ..... 399/263
2013/0028638 A1 * 1/2013 Tsuritani et al. ..... 399/258
2013/0084106 A1 * 4/2013 Tsuda et al. ..... 399/258
2013/0188994 A1 * 7/2013 Lee ..... 399/258
2013/0251412 A1 * 9/2013 Okamoto et al. ..... 399/258
2013/0259525 A1 * 10/2013 Maeshima ..... 399/119

FOREIGN PATENT DOCUMENTS

JP 2008-165065 A 7/2008
JP 2008-203677 A 9/2008
JP 2008-299123 A 12/2008
JP 2008-299124 A 12/2008

* cited by examiner

*Primary Examiner* — Billy Lactaoen
*Assistant Examiner* — Arlene Heredia Ocasio
(74) *Attorney, Agent, or Firm* — Studebaker & Brackett PC

(57) ABSTRACT

A toner case includes a case main body, an attachment member and a conveying member. The case main body has a discharge port configured to discharge a toner. The attachment member is provided at the case main body to be rotatable in normal and reverse rotation directions around a rotation axis. The conveying member is rotatable in the normal and reverse rotation direction around the rotation axis to convey the toner from/to the inside of the case main body to/from a side of the discharge port. When the attachment member is reversely rotated, the conveying member is moved in a direction of the rotation axis between a first position in which the conveying member is reversely rotated together with the attachment member and a second position in which the attachment member runs idle.

16 Claims, 11 Drawing Sheets

TONER CASE AND IMAGE FORMING APPARATUS

INCORPORATION BY REFERENCE

This application is based on and claims the benefit of priority from Japanese Patent application No. 2012-253488 filed on Nov. 19, 2012, the entire contents of which are incorporated herein by reference.

BACKGROUND

The present disclosure relates to a toner case configured to contain a toner (developer) and an image forming apparatus provided with the toner case.

In an electrographic image forming apparatus, a toner is supplied on an electrostatic latent image formed on a photoconductor drum or the like from a development device to carry out a development operation. The toner used for the development operation is supplied to the development device from a toner case, such as a toner container or an intermediate hopper or the like. Usually, the above-mentioned toner case is formed with a filling port for filling the toner into the toner case. After filling the toner case with the toner through the filling port, the filling port is closed with a cap.

For example, there exists a configuration that the filling port is closed with the cap from the inside of the toner case. Alternatively, there exists another configuration that by pulling out the cap from the filling port of the toner case a member inside the toner case is broken. There exists still another configuration that the filling port of the toner case is closed with the cap while the cap is covered with a cover member.

However, each configuration mentioned above needs to use the cap in order to close the filling port after filling the toner case with the toner, resulting in an increase in cost.

SUMMARY

In accordance with an embodiment of the present disclosure, a toner case includes a case main body, an attachment member and a conveying member. The case main body has a discharge port configured to discharge a toner. The attachment member is provided at the case main body to be rotatable in normal and reverse rotation directions around a rotation axis. The conveying member is provided at the case main body to be rotatable in the normal and reverse rotation directions around the rotation axis and connected to the attachment member. The conveying member conveys the toner from the inside of the case main body to a side of the discharge port when the conveying member is normally rotated. And, the conveying member conveys the toner from the side of the discharge port to the inside of the case main body when the conveying member is reversely rotated. The conveying member is movable in a direction of the rotation axis between a first position in which the conveying member is reversely rotated together with the attachment member when the attachment member is reversely rotated and a second position in which the conveying member makes the attachment member run idle when the attachment member is reversely rotated.

In accordance with an embodiment of the present disclosure, an image forming apparatus includes a toner case. The toner case has a case main body, an attachment member and a conveying member. The case main body has a discharge port configured to discharge a toner. The attachment member is provided at the case main body to be rotatable in normal and reverse rotation directions around a rotation axis. The conveying member is provided at the case main body to be rotatable in the normal and reverse rotation directions around the rotation axis and connected to the attachment member. The conveying member conveys the toner from the inside of the case main body to a side of the discharge port when the conveying member is normally rotated. And, the conveying member conveys the toner from the side of the discharge port to the inside of the case main body when the conveying member is reversely rotated. The conveying member is movable in a direction of the rotation axis between a first position in which the conveying member is reversely rotated together with the attachment member when the attachment member is reversely rotated and a second position in which the conveying member makes the attachment member run idle when the attachment member is reversely rotated.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
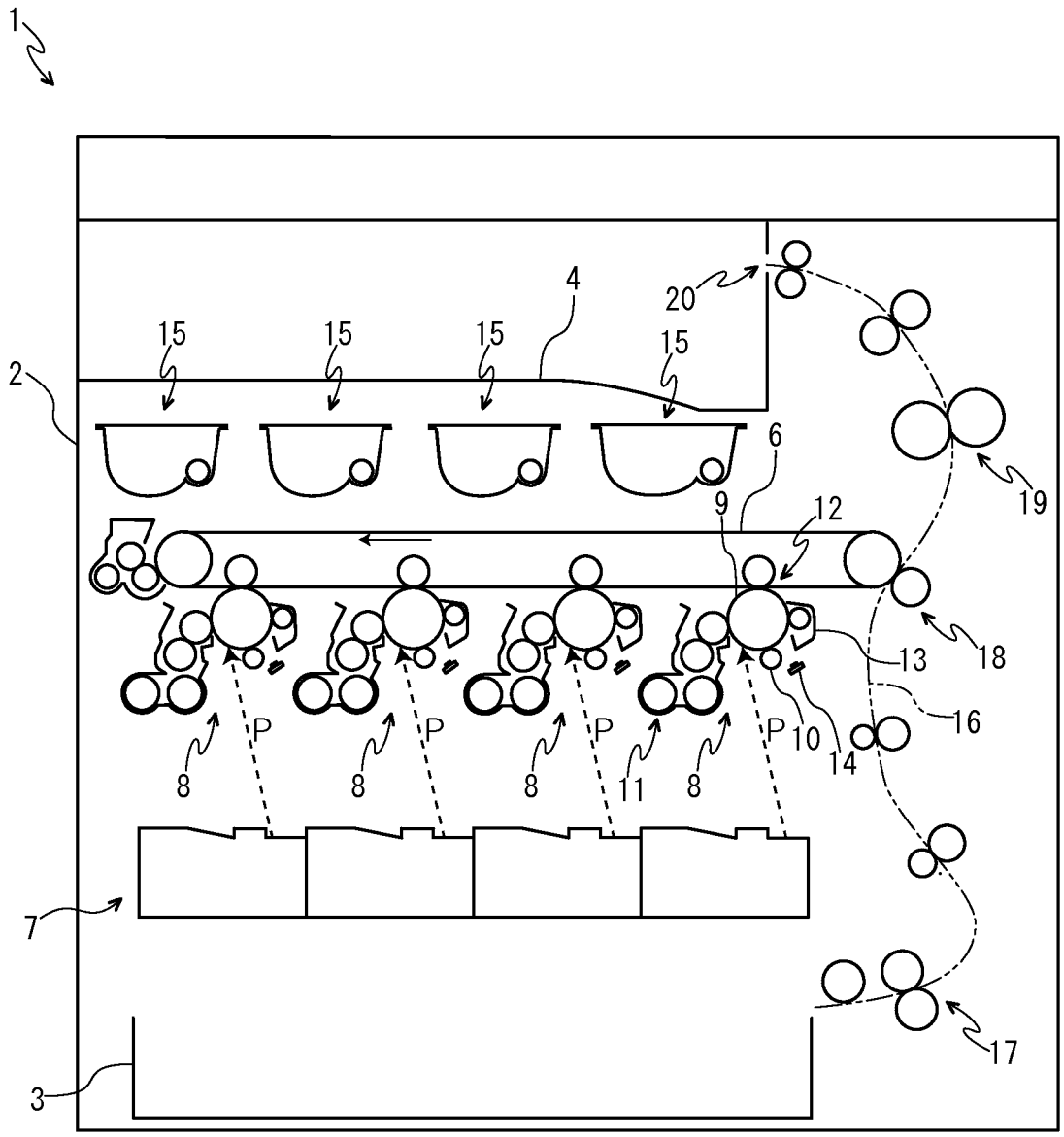
FIG. 1 is a schematic diagram schematically showing a color printer according to an embodiment of the present disclosure.

With reference to FIG. 1, the entire structure of a color printer 1 (an image forming apparatus) will be described.

FIG. 1 is a schematic diagram schematically showing the color printer 1 according to an embodiment of the present disclosure.

The color printer 1 includes a box-formed printer main body 2. In a lower part of the printer main body 2, a sheet feeding cartridge 3 storing sheets (not shown) is provided and, in an upper part of the printer main body 2, a sheet ejecting tray 4 is provided.

In a middle part of the printer main body 2, an intermediate transferring belt 6 is bridged over a plurality of rollers and, below the intermediate transferring belt 6, an exposure device 7 consisting of a laser scanning unit (LSU) is arranged. Near the intermediate transferring belt 6, four image forming units 8 are provided for respective colors (for example, four colors of magenta, cyan, yellow and black) of toners (developer) along the lower part of the intermediate transferring belt 6. Hereinafter, one of the four image forming units 8 will be described. In each image forming unit 8, a photosensitive drum 9 is rotatably provided. Around the photosensitive drum 9, a charger 10, a development device 11, a first transferring unit 12, a cleaning device 13 and a static eliminator 14 are arranged in order of a first transferring process. Above the development device 11, four toner containers 15 (toner cases) corresponding to the image forming units 8 are provided for different colors of toners, respectively.

On one side (the upper and right side in the figure) in the printer main body 2, a sheet conveying path 16 is provided. At an upper stream end of the conveying path 16, a sheet feeder 17 is provided. At an intermediate stream part of the conveying path 16, a second transferring unit 18 is provided at one end (the right end in the figure) of the intermediate transferring belt 6. At a lower stream part of the conveying path 16, a fixing device 19 is provided. At a lower stream end of the conveying path 16, a sheet ejecting port 20 is provided.

Next, the operation of forming an image by the color printer 1 having such a configuration will be described. When the power is supplied to the color printer 1, various parameters are initialized and initial determination, such as temperature determination of the fixing device 19, is carried out. Subsequently, when image data is inputted and a printing start is directed from a computer or the like connected with the color printer 1, the image forming operation is carried out as follows.

First, the surface of the photosensitive drum 9 is electrically charged by the charger 10. Then, the surface of the photosensitive drum 9 is irradiated with a laser (refer to arrow P) by the exposure device 7, thereby forming an electrostatic latent image on the surface of the photosensitive drum 9. The electrostatic latent image is developed to a toner image having a correspondent color by the developing device 11 with a toner supplied from the toner container 15. The toner image is first-transferred onto the surface of the intermediate transferring belt 6 in the first transferring unit 12. The above-mentioned operation is repeated in order by the image forming units 8, thereby forming the toner image having full color onto the intermediate transferring belt 6. Toner and electric charge remained on the photosensitive drum 9 are eliminated by the cleaning device 13 and static eliminator 14.

On the other hand, a sheet fed from the sheet feeding cartridge 3 or a manual bypass tray (not shown) by the sheet feeder 17 is conveyed to the second transferring unit 18 in a suitable timing for the above-mentioned image forming operation. Then, in the second transferring unit 18, the toner image having full color on the intermediate transferring belt 6 is second-transferred onto the sheet. The sheet with the second-transferred toner image is conveyed to a lower stream side on the conveying path 16 to enter the fixing device 19, and then, the toner image is fixed on the sheet in the fixing device 19. The sheet with the fixed toner image is ejected from the first sheet ejecting port 20 onto the first sheet ejecting tray 4.

Next, with reference to FIGS. 2-11, the toner container 15 will be described in detail. Arrows Fr put on each figure indicates the front side of the toner container 15. Arrows X suitably put on each figure indicate a clockwise direction in a front view. Hereinafter, the direction is defined as a normal rotation direction. Arrows Y suitably put on each figure indicate a counterclockwise direction in a front view. Hereinafter, the direction is defined as a reverse rotation direction.

Figure 2:
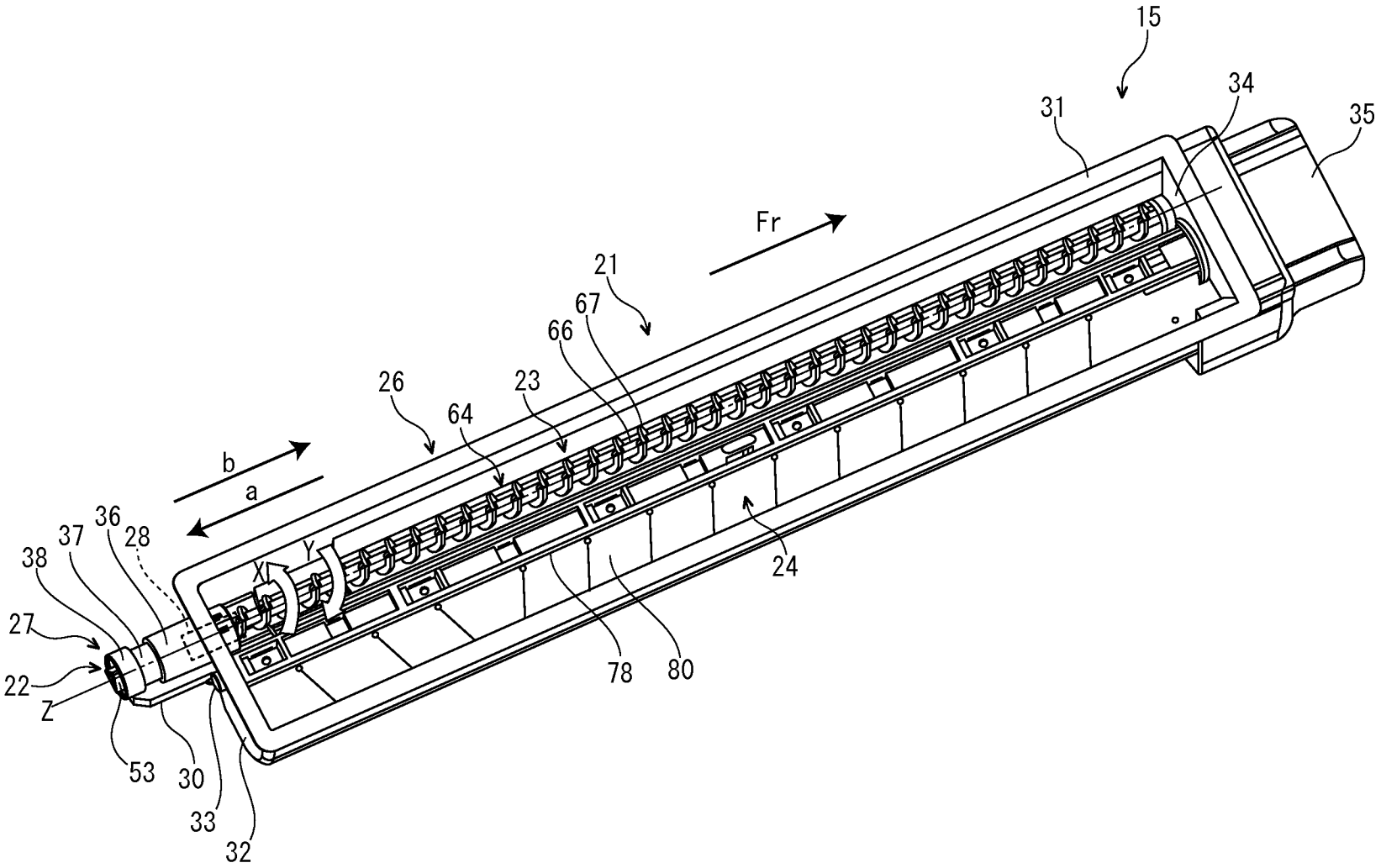
FIG. 2 is a top perspective view showing a toner container without a covering body in the color printer according to the embodiment of the present disclosure.
Figure 3:
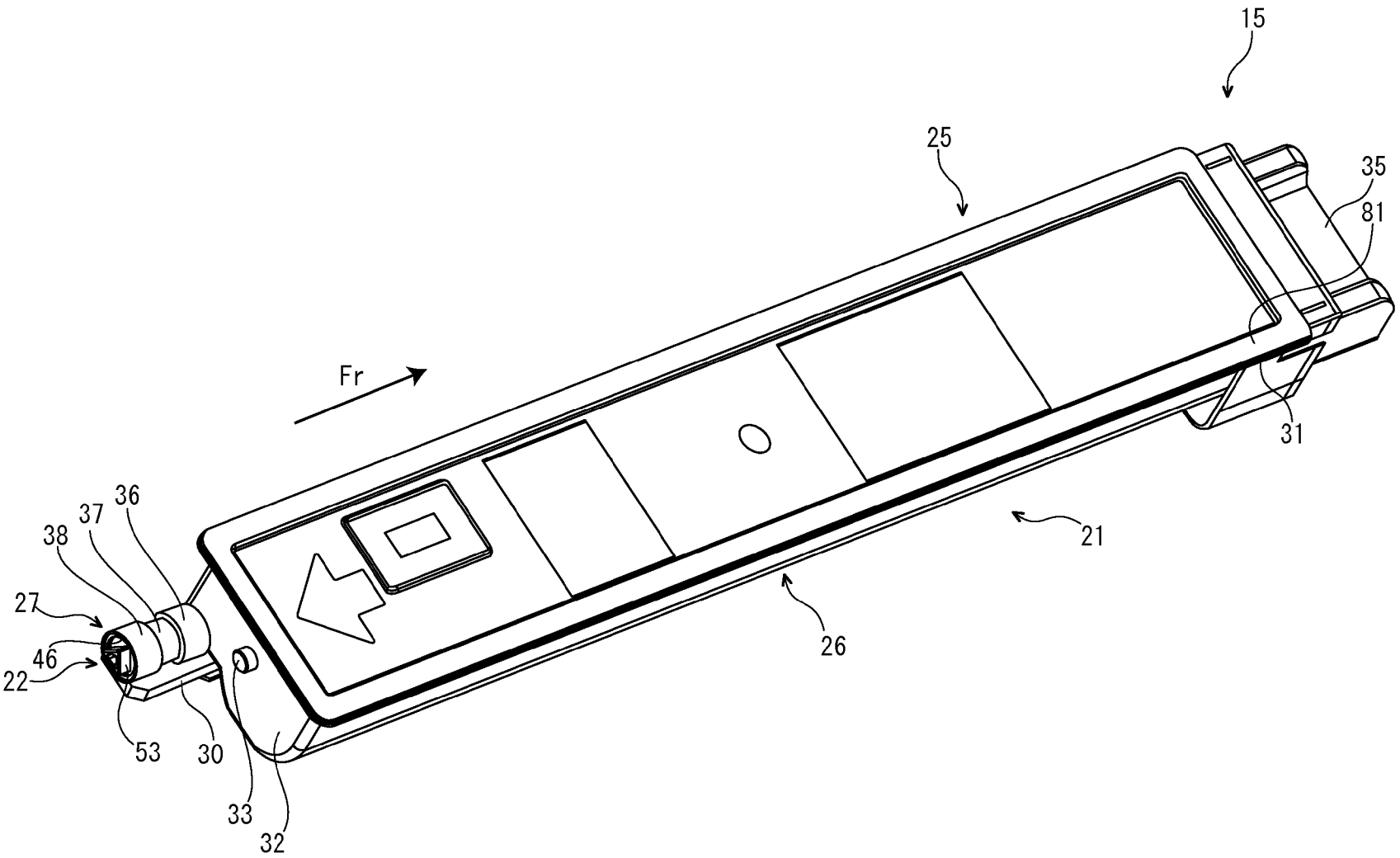
FIG. 3 is a top perspective view showing the toner container of the color printer according to the embodiment of the present disclosure.

As shown in FIGS. 2 and 3, the toner container 15 is formed in an extended-shape in forward and backward directions. The toner container 15 includes a container main body 21(case main body), an attachment member 22 attached on the back end of the container main body 21, a conveying screw 23 (a conveying member) provided at the right and lower part of the container main body 21, an agitating paddle 24 provided at the approximate middle of the container main body 21 and a covering body 25 for covering the upper surface of the container main body 21. Hereinafter, each of the components will be described in the above-mentioned order.

Firstly, the container main body 21 will be described. As shown in FIG. 2 and others, the container main body 21 has a container part 26 containing the toner and a duct part 27 projecting backward from the right side of the back end of the container part 26. On the bottom surface of the container main body 21, a discharge port 28 configured to discharge the toner is formed across the container part 26 and the duct part 27. The lower side of the discharge port 28 is closed with a slide shutter 30 openably and closably. The container main body 21 is not formed with, so-called, a "filling port" made specially for filling the toner.

The container part 26 is formed in an box-shape with the upper side opened. At the upper end of the container part 26, a main body side flange 31 is provided. At the middle of the upper portion of the back wall 32 of the container part 26, a bearing 33 is provided. On the front surface of the front wall 34 of the container part 26, a gear cover 35 is welded.

Figure 4:
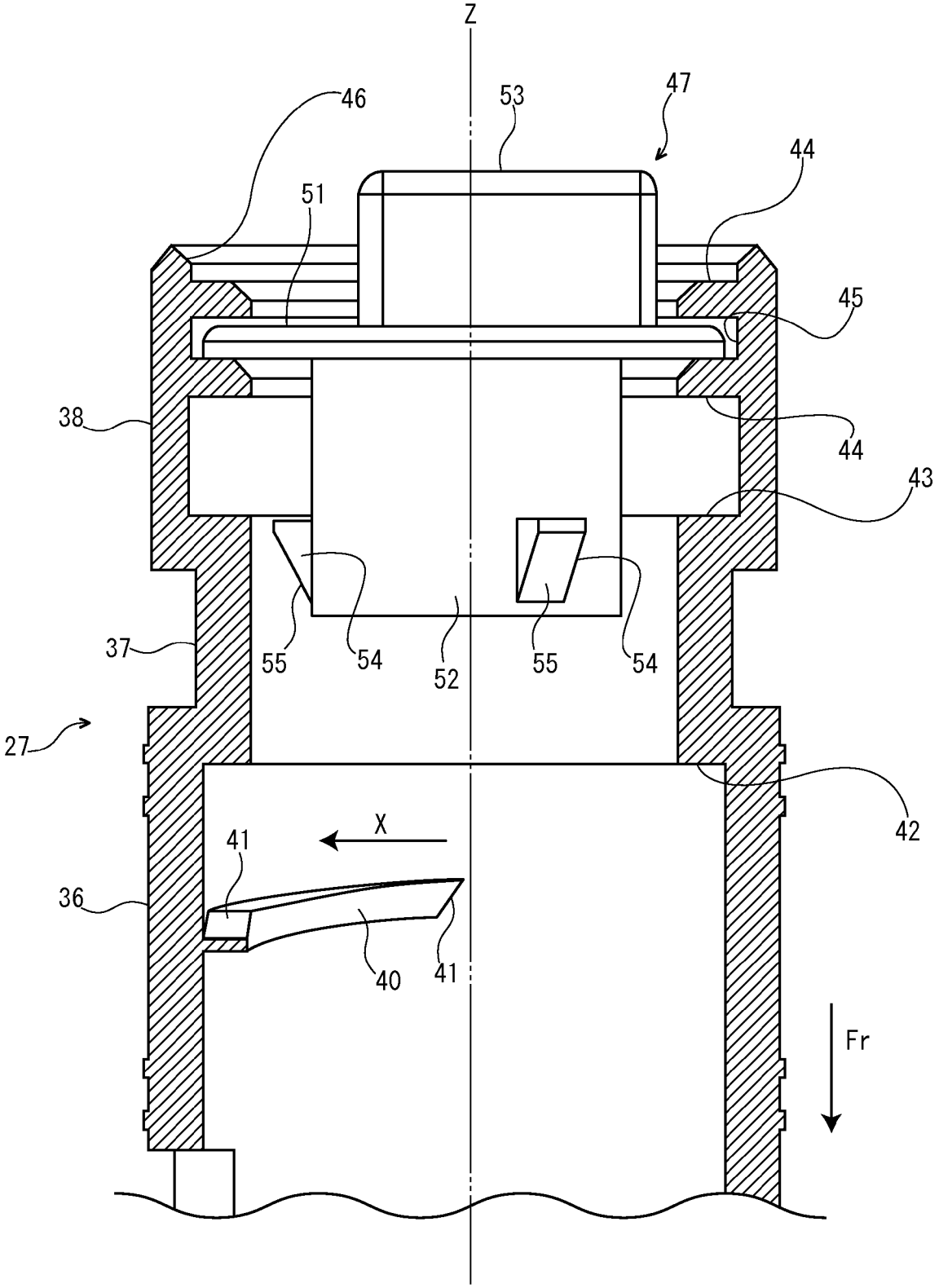
FIG. 4 is a sectional view showing a duct part and a first attachment body of the toner container of the color printer according to the embodiment of the present disclosure.

As shown in FIG. 4, the duct part 27 has a cylindrical first tubular portion 36 provided at the front end thereof (the end on the side closer to the container part 26), a cylindrical second tubular portion 37 provided on the back side of the first tubular portion 36 and a third tubular portion 38 provided on the back side of the second tubular portion 37.

On the inner circumference face of the first tubular portion 36, a pair of guiding ribs 40 (one of the ribs is shown in FIG. 4) are provided. Each guiding rib 40 has a length of ¼ of the entire perimeter of the inner circumference face of the first tubular portion 36 and is positioned diagonally. Each guiding rib 40 is inclined from the back side to the front side in the normal rotation direction (referring to arrow X in FIG. 4). The guiding ribs 40 are formed with guiding surfaces 41 at the upstream and downstream ends in the normal rotation direction. The guiding surfaces 41 have an inclined angle to the normal rotation direction larger than that of the upper and lower surfaces of the guiding ribs 40.

The second tubular portion 37 has a length in the forward and backward directions shorter than that of the first tubular portion 36. Since the second tubular portion 37 has an inner diameter smaller than an inner diameter of the first tubular portion 36, a front side stepped portion 42 is formed between the first tubular portion 36 and the second tubular portion 37.

The third tubular portion 38 has a length in the forward and backward directions shorter than that of the first tubular portion 36 and longer than that of the second tubular portion 37.

Since the third tubular portion 38 has an inner diameter substantially equal to the inner diameter of the first tubular portion 36 and larger than the inner diameter of the second tubular portion 37, a back side stepped portion 43 is formed between the second tubular portion 37 and the third tubular portion 38. On the backward of the inner circumference face of the third tubular portion 38, a pair of front and back annular projections 44 are protruded. Between the annular projections 44, an annular groove 45 is formed. At the back end of the third tubular portion 38, an opening 46 is formed.

Figure 5:
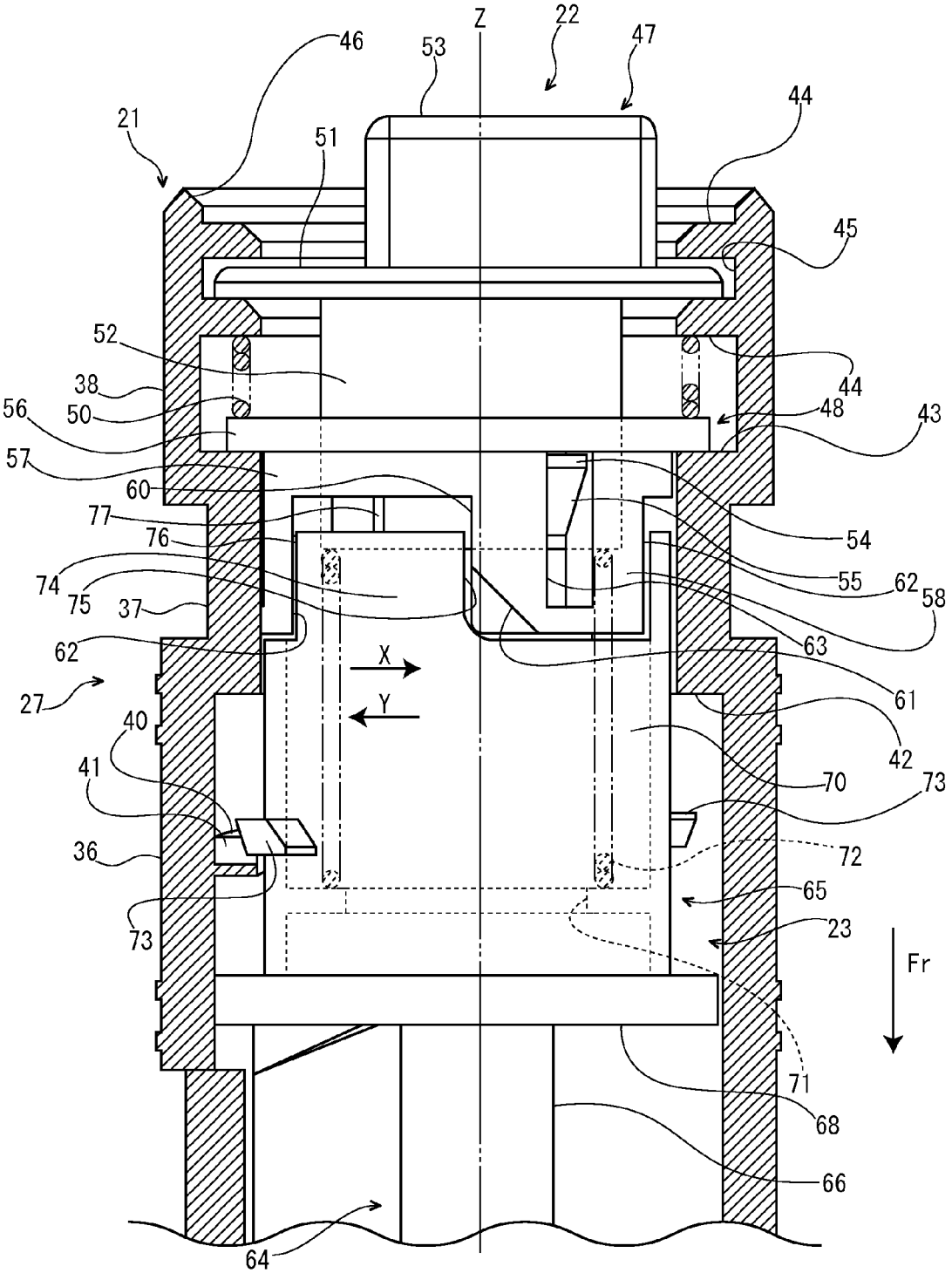
FIG. 5 is a sectional view showing a conveying screw at a first position in the toner container of the color printer according to the embodiment of the present disclosure.

Next, the attachment member 22 will be described. As shown in FIG. 5, the attachment member 22 is stored in the duct part 27 of the container main body 21 so as to be rotatable in the normal and reverse directions around a rotation axis Z. The attachment member 22 has a first attachment body 47 attached to the back end of the duct part 27 so as to be rotatable in the normal and reverse directions and a second attachment body 48 attached to the duct part 27 in front of the first attachment body 47 so as to be rotatable in the normal and reverse directions.

Figure 6:
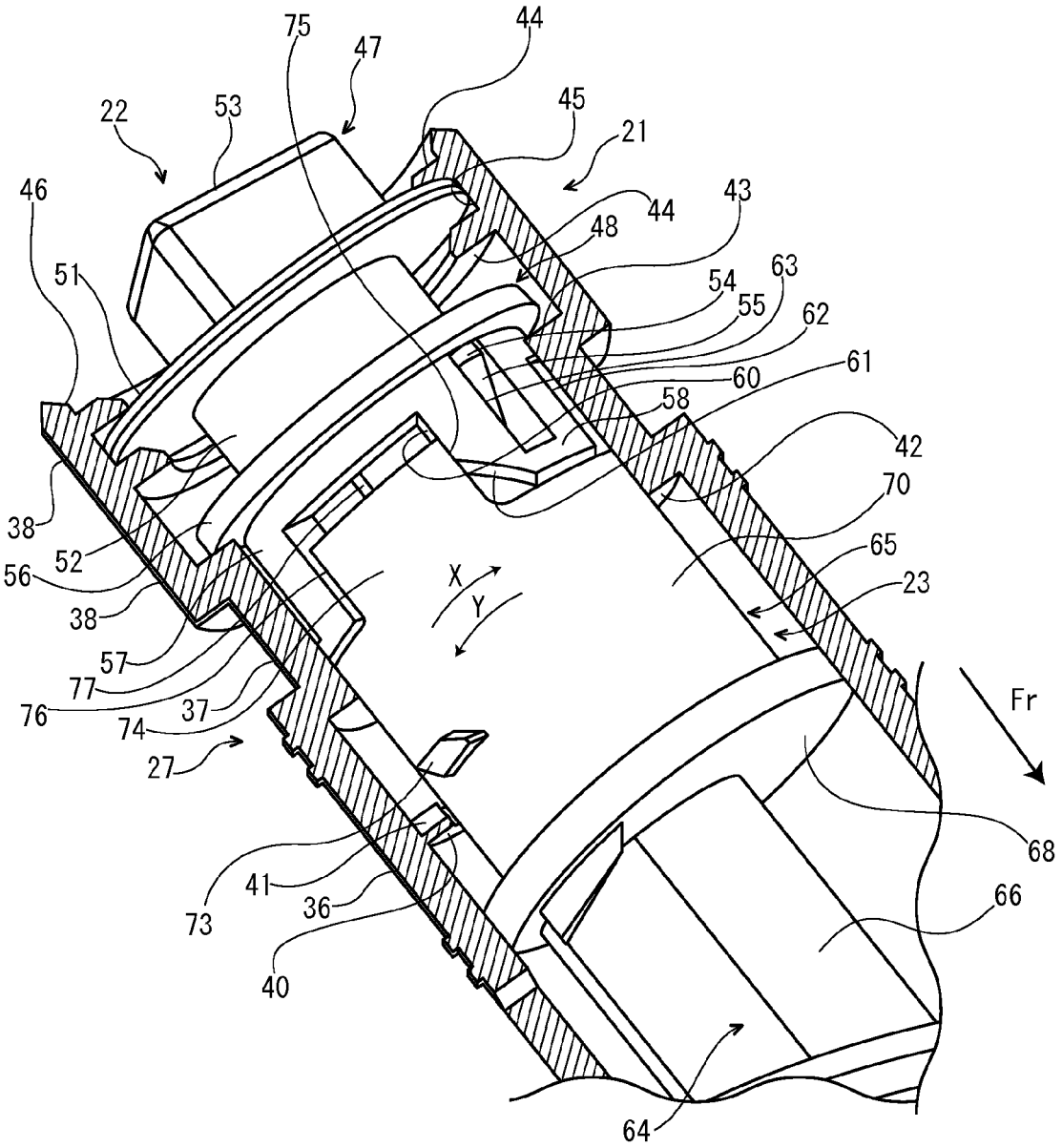
FIG. 6 is a perspective sectional view showing the conveying screw at a first position in the toner container of the color printer according to the embodiment of the present disclosure.

As shown in FIGS. 5 and 6, the first attachment body 47 has a disk-shaped first flange portion 51, a first connecting portion 52 protruding forward from the first flange portion 51 and a coupling portion 53 protruding backward from the first flange portion 51.

The outer circumference portion of the first flange portion 51 is inserted in the annular groove 45 provided at the third tubular portion 38 of the duct part 27. This restricts the movement of the first attachment body 47 in the forward and backward directions (the direction of the rotation axis Z).

The first connecting portion 52 is formed in a cylindrical shape. The first connecting portion 52 is stored in a space from the second tubular portion 37 to the third tubular portion 38 of the duct part 27. As shown in FIG. 4, on the distal end (the front end) of the outer circumference face of the first connecting portion 52, a plurality of (for example, three) projection portions 54 are provided at predetermined intervals (for example, interval of 120 degree) in the circumferential direction. Each projection portion 54 is provided with a tapered surface 55 inclined backward and upward from the outer circumference face of the first connecting portion 52.

As shown in FIG. 3 and others, the coupling portion 53 is formed in a triangle pole-shape in a back view. The coupling portion 53 protrudes backward from the duct part 27 through the opening 46 formed at the third tubular portion 38 of the duct part 27 and is opened to the outside of the container main body 21.

As shown in FIGS. 5 and 6, the second attachment body 48 is arranged between the first attachment body 47 and the conveying screw 23 in a movable condition in the forward and backward directions (the direction of the rotation axis Z). The second attachment body 48 has a ring-shaped second flange portion 56 and a second connecting portion 57 protruding forward from the second flange portion 56.

The second flange portion 56 is stored in the third tubular portion 38 of the duct part 27. The second flange portion 56 comes in contact with the back stepped portion 43 formed between the second tubular portion 37 and the third tubular portion 38 of the duct part 27. This restricts the forward movement of the second attachment body 48.

As shown in FIG. 5 and others, between the second flange portion 56 and the front annular projection 44 provided at the third tubular portion 38 of the duct part 27, a coil spring 50 (a biasing body) is arranged. The coil spring 50 biases the second attachment body 48 forward (the side of the conveying screw 23). The coil spring 50 is not shown in the figures except FIGS. 5 and 7.

The second connecting portion 57 is stored in the second tubular portion 37 of the duct part 27. The second connecting portion 57 has a plurality of (for example, three) pressing pieces 58 protruding forward at predetermined intervals (for example, interval of 120 degree) in the circumferential direction. Each pressing piece 58 is formed in an approximately rectangle shape. At the downstream edge portion of each pressing piece 58 in the reverse direction Y (the upstream edge portion in the normal rotation direction X), a first pressing portion 60 (a pressing portion) provided along the forward and backward directions (a direction of the rotation axis Z) and an inclined portion 61 provided contiguously to and in front of the first pressing portion 60 and inclined relative to the forward and backward directions (the direction of the rotation axis Z). The inclined portion 61, in detail, is inclined backward toward the downstream side in the reverse rotation direction Y. At the downstream edge portion of each pressing piece 58 in the normal rotation direction X (the upstream edge portion in the reverse rotation direction Y), a second pressing portion 62 is provide along the forward and backward directions.

Each pressing piece 58 is provided with a plurality of (for example, three) hole portions 63. The hole portions 63 are provided at predetermined intervals (for example, interval of 120 degree) in the circumferential direction. Each hole portion 63 is formed in a rectangle shape extending in the forward and backward directions. With each hole portion 63, each projection portion 54 provided at the first attachment body 47 is engaged. This restricts the relative rotation of the second attachment body 48 to the first attachment body 47.

Next, the conveying screw 23 will be described. As shown in FIG. 2, the conveying screw 23 is formed in an extended-shape in the forward and backward directions and stored in the container main body 21 so as to be rotatable in the normal and reverse rotation directions around the above-mentioned rotation axis Z. That is, the conveying screw 23 is configured to rotate in the normal and reverse rotation directions around the same axis as the attachment member 22.

The conveying screw 23 is provided movably in the forward and backward directions (the direction of the rotation axis Z). Hereinafter, a position where the conveying screw 23 is moved backward (referring to FIGS. 5 and 6) is called "a first position" of the conveying screw 23 and a position where the conveying screw 23 is moved forward (referring to FIGS. 7 and 8) is called "a second position" of the conveying screw 23.

The conveying screw 23 has a screw main body 64 (a conveying member main body) extending along the forward and backward directions (the direction of the rotation axis Z) and a connecting body 65 fixed at the back end (one end of the rotation axis Z) of the screw main body 64.

As shown in FIG. 2, the screw main body 64 has a screw shaft 66 and a spiral fin 67 formed around the screw shaft 66. The front end of the screw shaft 66 is passed through the front wall 34 of the container part 26 of the container main body 21 and supported by the front wall 34.

The spiral fin 67 is provided along almost all length of the screw main body 64 from the front end to the back end. The orientation of the spiral fin 67 is set so that the toner is conveyed (referring to arrow a in FIG. 2) from the inside of the container part 26 to a side of the discharge port 28 when the conveying screw 23 is normally rotated and the toner is conveyed (referring to arrow b in FIG. 2) from the side of the discharge port 28 to the inside of the container part 26 when the conveying screw 23 is reversely rotated.

As shown in FIGS. 5 and 6, the connecting body 65 has a collar portion 68 coupled to the back end of the screw main body 64 and a connecting tubular portion 70 protruding backward from the collar portion 68.

The collar portion 68 is formed in a disk shape and stored in the first tubular portion 36 of the duct part 27 of the container main body 21. The collar portion 68 has an outer diameter smaller than the inner diameter of the first tubular portion 36 of the duct part 27 and larger than the inner diameter of the second tubular portion 37 of the duct part 27.

The connecting tubular portion 70 is formed in a cylindrical shape and stored in a space from the first tubular portion 36 to the second tubular portion 37 of the duct part 27 of the container main body 21. The connecting tubular portion 70 has an outer diameter smaller than the inner diameters of the first tubular portion 36 and the second tubular portion 37 of the duct part 27. On the inner circumference face of the connecting tubular portion 70, an annular spring bearing 71 protrudes. Between the spring bearing 71 and the first connecting portion 52 of the first attachment body 47, a biasing spring 72 (a biasing member) is arranged. The biasing spring 72 biases the conveying screw 23 to the second position (referring to FIGS. 7 and 8). The biasing spring 72 is not shown in the figures except FIGS. 5 and 7.

As shown in FIG. 5 and others, on the front portion of the outer circumference face of the connecting tubular portion 70, a pair of guided pieces 73 are protruded at the corresponding positions to the guiding ribs 40 provided at the first tubular portion 36 of the duct part 27 in the forward and backward directions. Each guided piece 73 is positioned diagonally. The guided pieces 73 are formed in an approximately parallelogram shape.

At the distal end (the back end) of the connecting tubular portion 70, a plurality of (for example, three) pressed pieces 74 are protruded at predetermined intervals (for example, interval of 120 degree) in the circumferential direction. Each pressed piece 74 is formed in a rectangle shape. At the upstream edge portion in the reverse rotation direction Y (the downstream edge portion in the normal rotation direction X) of each pressed piece 74, a first pressed portion 75 (a pressed portion) is provided along the forward and backward directions (the direction of the rotation axis Z). At the upstream edge portion in the normal rotation direction X (the downstream edge portion in the reverse rotation direction Y) of each pressed piece 74, a second pressed portion 76 is provided along the forward and backward directions (the direction of the rotation axis Z).

Each pressed piece 74 is inserted into a space between the pressing pieces 58 provided at the second connecting portion 57 of the second attachment member 48. This connects the connecting body 65 of the conveying screw 23 to the second attachment body 48 of the attachment member 22 and restricts the relative rotation of the conveying screw 23 to the attachment member 22. The distal end of each pressed piece 74 and the second connecting portion 57 of the second attachment body 48 are coupled by coupling pieces 77 extending in the forward and backward directions (the direction of the rotation axis Z). This holds the conveying screw 23 at the first position against the biasing force of the biasing spring 72. The plurality of coupling pieces 77 are, for example, provided at a space between the pressing pieces 58 at predetermined intervals (for example, interval of 120 degree).

Next, the agitating paddle 24 will be described. As shown in FIG. 2, the agitating paddle 24 has a supporting frame 78 formed in a plate frame shape and a sheet-shaped agitating fin 80 supported by the supporting frame 78. The back end of the supporting frame 78 is supported by the bearing 33 provided at the back wall 32 of the container part 26 of the container main body 21. The front end of the supporting frame 78 is passed through the front wall 34 of the container part 26 of the container main body 21 and supported by the front wall 34. This allows the agitating paddle 24 to be rotatable. The front end of the supporting frame 78 is connected to the front end of the screw shaft 66 of the screw main body 64 via gear train (not shown) provided at a space between the front wall 34 of the container part 26 of the container man body 21 and the gear cover 35. By this configuration, when the conveying screw 23 is rotated, the rotation is transmitted to the agitating paddle 24 via the above-mentioned gear train and thus the agitating paddle 24 is rotated.

Next, the covering body 25 will be described. As shown in FIG. 3, the covering body 25 is formed in a rectangular shape extending in the forward and backward directions. At the outer circumference of the covering body 25, a covering body side flange 81 is provided. The covering body side flange 81 has a shape corresponding to the shape of the main body side flange 31 provided at the container part 26 of the container main body 21. The main body side flange 31 and the covering body side flange 81 are ultrasonic-welded to integrate the container main body 21 and the covering body 25 into one body.

In the above-mentioned configuration, when the toner container 15 is filled with the toner, a filling coupling of a filling machine (not shown) is coupled to the coupling portion 53 provided at the first attachment body 47 of the attachment member 22. Then, under a condition in which the conveying screw 23 is positioned at the first position (referring to FIGS. 5 and 6), a driving source, such as a motor, connected to the filling coupling is rotated. And, the rotation of the driving source is transmitted to the first attachment body 47 of the attachment member 22 to rotate the attachment member 22 reversely. When the attachment member 22 is reversely rotated in this way, the first pressing portion 60 provided at the second attachment body 48 of the attachment member 22 presses the first pressed portion 75 provided at the connecting body 65 of the conveying screw 23 and, thus, the conveying screw 23 are reversely rotated together with the attachment member 22.

Under a condition in which the conveying screw 23 is reversely rotated, when the toner is supplied to the discharge port 28 provided at the container main body 21 from the above-mentioned filling machine, as shown in arrow b in FIG. 2, the toner is conveyed from the side of the discharge port 28 to the inside of the container part 26 and fills the container part 26.

Figure 9A:
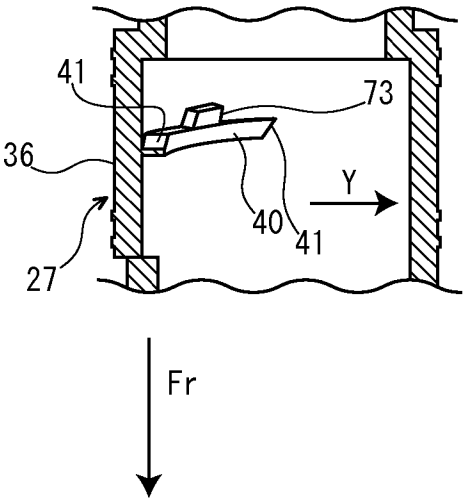
FIGS. 9A, 9B and 9C are sectional views showing an operation of a guided piece when the conveying screw is reversely rotated at the first position in the toner container of the color printer according to the embodiment of the present disclosure.

Further, when the conveying screw 23 is reversely rotated, as shown in FIG. 5, the guided piece 73 provided at the connecting body 65 of the conveying screw 23 comes in contact with the guiding surface 41 of the guiding rib 40 provided at the duct part 27. That is, the guided piece 73 is engaged with the guiding rib 40. Then, when the conveying screw 23 is further rotated reversely, as shown in FIG. 9A, the guided piece 73 passes over the guiding surface 41 of the guiding rib 40 and is moved along the back surface of the guiding rib 40. With this movement, the conveying screw 23 and the second attachment body 48 are moved together backward against the biasing force of the coil spring 50.

Figure 9B:
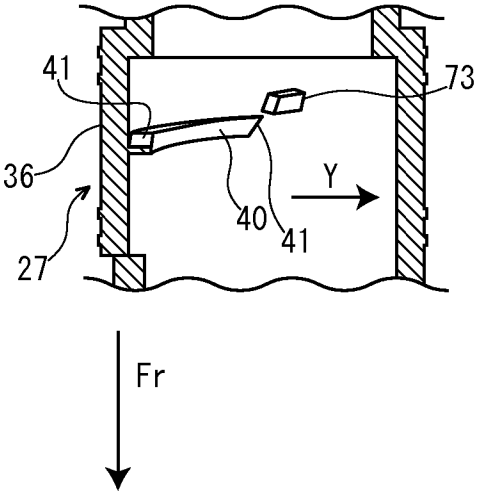
Figure 9C:
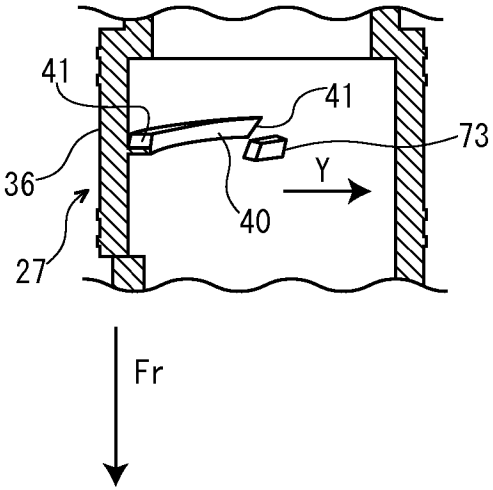

When the conveying screw 23 is further rotated reversely, as shown in FIG. 9B, the guided piece 73 is moved to the downstream side in the reverse rotation direction beyond the guiding rib 40. That is, the guided piece 73 is disengaged with the guiding rib 40. With this, the conveying screw 23 and the second attachment body 48 are moved together forward by the biasing force of the coli spring 50. And, as shown in FIG. 9C, the guided piece 73 is also moved forward.

During the reverse rotating of the conveying screw 23, the above-mentioned engagement and disengagement of the guided piece 73 and the guiding rib 40 are repeated. Since the conveying screw 23 and the second attachment body 48 are moved together in the forward and backward directions, the coupling pieces 77 coupling the conveying screw 23 to the second attachment body 48 are not broken.

On the other hand, in the above-mentioned configuration, when the toner is discharged from the toner container 15, the toner container 15 is mounted on the printer main body 2 and a driving coupling (not shown) provided at the printer main body 2 is coupled to the coupling portion 53 provided at the first attachment body 47 of the attachment member 22. Then, the driving source, such as the motor, connected to the driving coupling is rotated. When the driving source is rotated in this way, the rotation of the driving source is transmitted to the first attachment body 47 of the attachment member 22 to rotate the attachment member 22 normally. When the attachment member 22 is normally rotated in this way, the second pressing portion 62 of the pressing piece 58 provided at the second attachment body 48 of the attachment member 22 presses the second pressed portion 76 provided at the connecting body 65 of the conveying screw 23 and, thus, the conveying screw 23 is normally rotated together with the attachment member 22.

When the conveying screw 23 is normally rotated, as shown in arrow a in FIG. 2, the toner is conveyed from the inside of the container part 26 to the side of the discharge port 28 and discharged through the discharge port 28. The discharged toner is supplied to the development device 11.

Figure 10A:
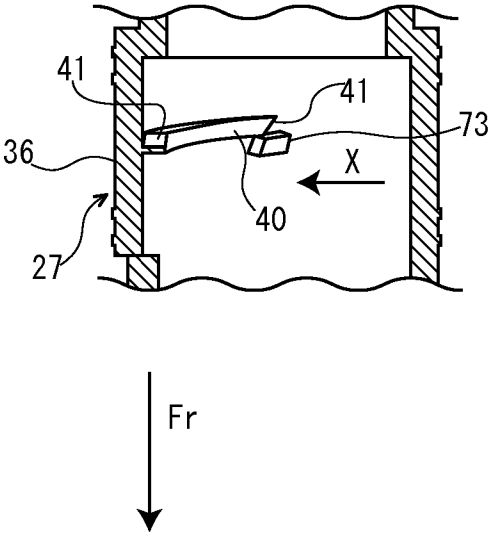
FIGS. 10A, 10B and 10C are sectional views showing an operation of the guided piece when the conveying screw is normally rotated at the first position in the toner container of the color printer according to the embodiment of the present disclosure.
Figure 10B:
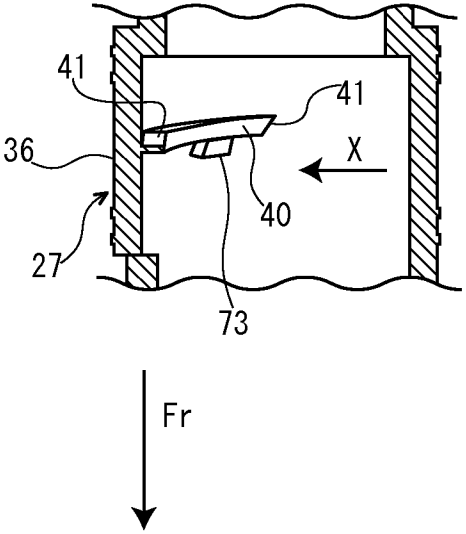
Figure 10C:
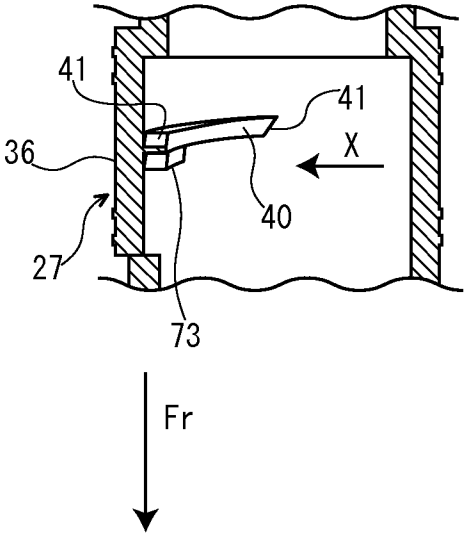

When the conveying screw 23 is normally rotated under a condition in which the conveying screw 23 is held at the first position as mentioned above, as shown in FIG. 10A, the guided piece 73 provided at the connecting body 65 of the conveying screw 23 comes in contact with the front surface of the guiding rib 40 provided at the first tubular portion 36 of the duct part 27. That is, the guided piece 73 is engaged with the guiding rib 40. When the conveying screw 23 is further rotated normally, as shown in FIGS. 10B and 10C, the guided piece 73 is moved along the front surface of the guiding rib 40.

Figure 7:
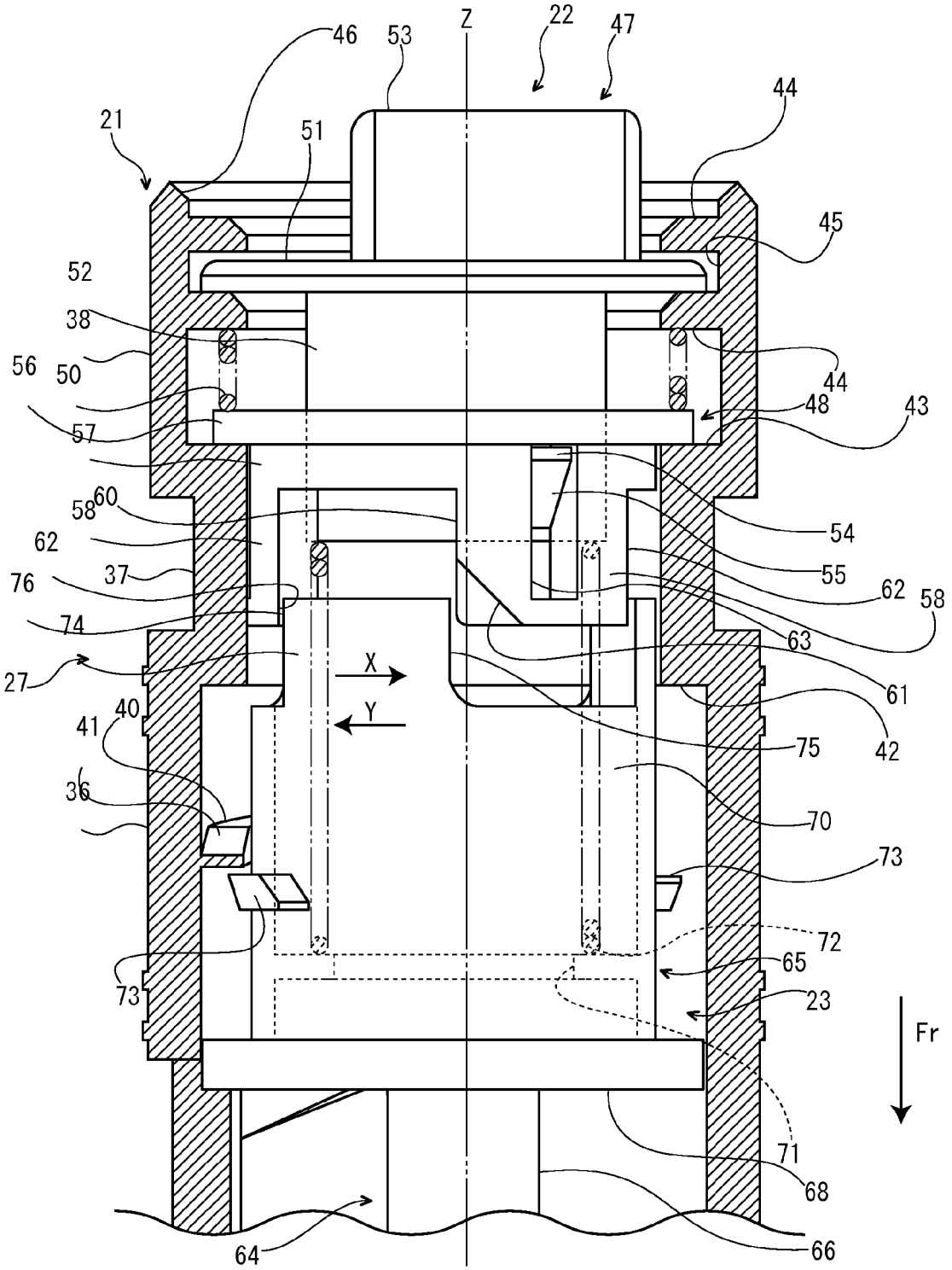
FIG. 7 is a sectional view showing the conveying screw at a second position in the toner container of the color printer according to the embodiment of the present disclosure.
Figure 8:
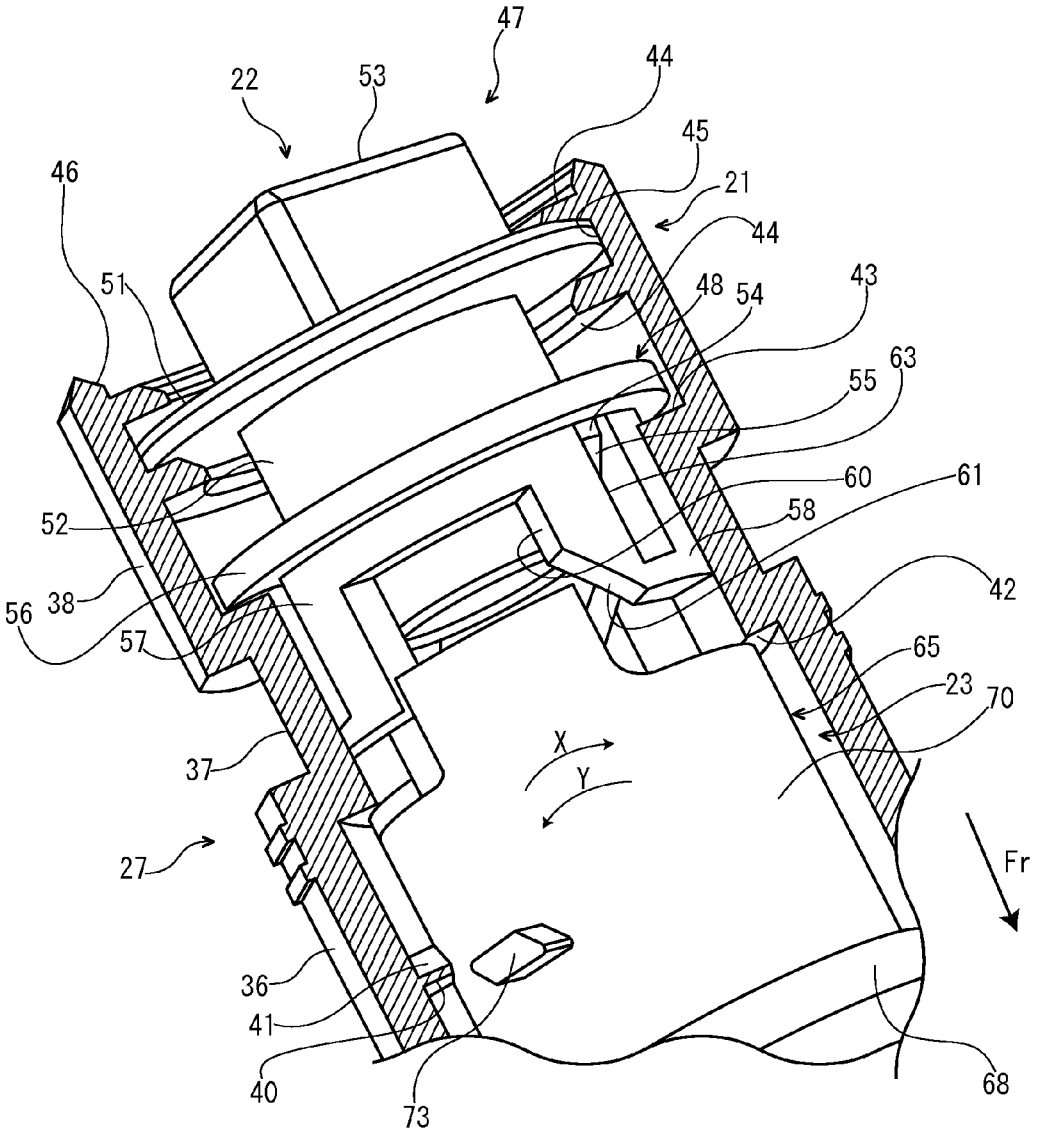
FIG. 8 is a perspective sectional view showing the conveying screw at the second position in the toner container of the color printer according to the embodiment of the present disclosure.

With this movement, the conveying screw 23 is moved from the first position side (back side) to the second position side (front side) against the biasing force of the biasing spring 72 and the coupling pieces 77 coupling the second attachment body 48 to the conveying screw 23 are broken. When the coupling pieces 77 are broken in this way, as shown in FIG. 7, the conveying screw 23 is held at the second position by the biasing force of the biasing spring 72.

Even if the conveying screw 23 is moved from the first position to the second position as mentioned above, as shown in FIG. 7, the second pressing portion 62 of the pressing piece 58 provided at the second attachment body 48 of the attachment member 22 is held at a condition facing the second pressed portion 76 of the pressed piece 74 provided at the connecting body 65 of the conveying screw 23. Therefore, when the attachment member 22 is normally rotated, the second pressing portion 62 of the pressing piece 58 presses the second pressed portion 76 of the pressed piece 74 and, thus, the conveying screw 23 is normally rotated together with the attachment member 22.

Figure 11A:
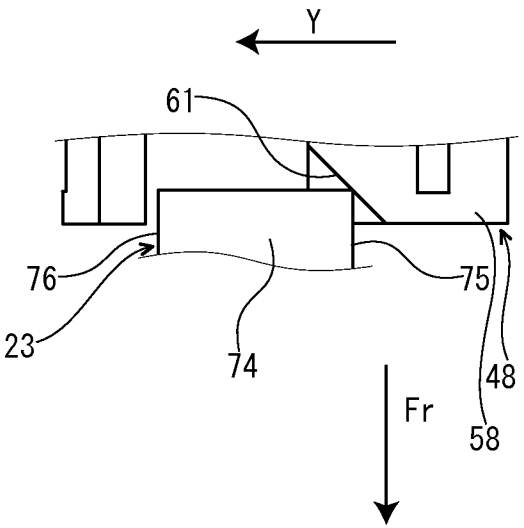
FIGS. 11A, 11B and 11C are sectional views showing an operation of a second attachment body when the conveying screw is reversely rotated at the second position in the toner container of the color printer according to the embodiment of the present disclosure.
Figure 11B:
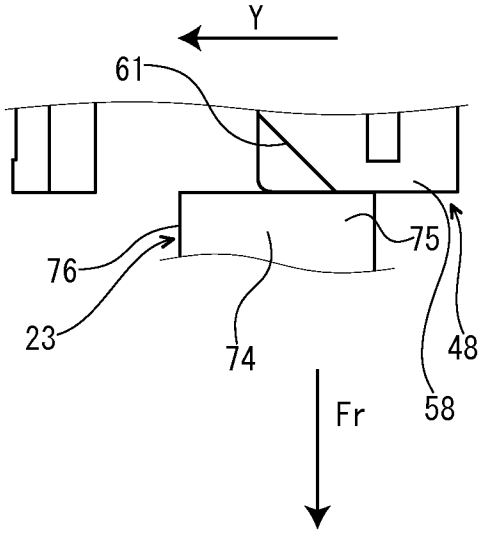
Figure 11C:
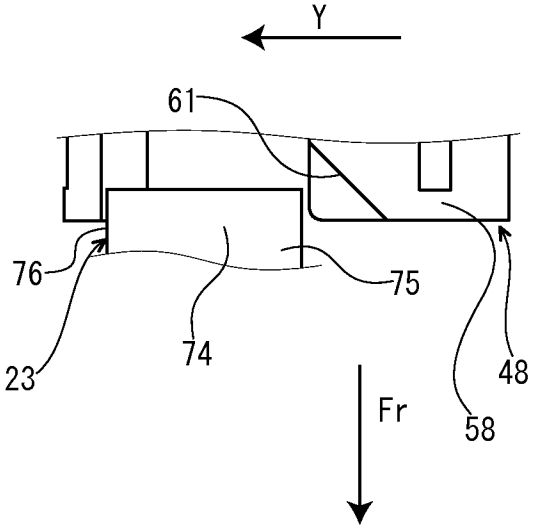

On the other hand, when the attachment member 22 is reversely rotated under a condition in which the conveying screw 23 is held at the second position by the biasing force of the biasing spring 72 as mentioned above, as shown in FIG. 11A, the inclined portion 61 of the pressing piece 58 provided at the second attachment body 48 presses the distal end of the first pressed portion 75 provided at the pressed piece 74 of the conveying screw 23. When the attachment member 22 is further rotated reversely, as shown in FIG. 11B, the second attachment body 48 is moved to the back side (a side spaced away from the conveying screw 23) against the biasing force of the coil spring 50 and the pressing piece 58 rides on the pressed piece 74. When the attachment member 22 is further rotated reversely, as shown in FIG. 11C, the pressing piece 58 passes over the pressed piece 74 and the second attachment body 48 is moved forward by the biasing force of the coil spring 50.

As mentioned above, since the pressing piece 58 passes over the pressed piece 74, the rotation is not transmitted from the pressing piece 58 to the pressed piece 74 and, therefore, the attachment member 22 runs idle relative to the conveying screw 23. Accordingly, the conveying screw 23 is not rotated and, even if the toner would be supplied to the discharge port 28 from the filling machine (not shown), the toner is not conveyed from the discharge port 28 to the inside of the container part 26. Also, the toner container 15 is not filled with the toner.

In this embodiment, as mentioned above, the normal and reverse rotation of the conveying screw 23 allows the both discharging and filling of the toner through the discharge port 28 so that the toner can be filled without using the filling port. Accordingly, not only the filling port but also the cap for closing the filling port is not necessary, resulting in a decrease of cost. And, since the conveying screw 23 is movable between the first position and the second position, it becomes possible to switch a condition in which the filling of the toner is possible and another condition in which the toner is discharged.

Furthermore, after the completion of the filling of the toner into the toner container 15, in order to supply the toner to the development device 11, the conveying screw 23 is normally rotated so as to discharge the toner through the discharge port 28. If the conveying screw 23 would be reversely rotated after the completion of the filling the toner into the toner container 15, the toner is spaced away from the discharge port 28 and a supply efficiency of the toner to the development device 11 may be lowered.

However, the embodiment is configured that, when the conveying screw 23 is normally rotated under a condition in which the conveying screw 23 is held at the first position, the conveying screw 23 is moved from the first position side to the second position side to break the coupling pieces 77 and to hold the conveying screw 23 at the second position by the biasing force of the biasing spring 72. By applying such a configuration, when once the conveying screw 23 is normally rotated after the completion of the filling of the toner into the toner container 15 and then the toner is discharged from the toner container 15, the conveying screw 23 is moved from the first position to the second position. After then, if the attachment member 22 would be reversely rotated, the attachment member 22 runs idle and the conveying screw 23 is not rotated reversely. Accordingly, the situation in which the toner is spaced away from the discharge port 28 is avoided and it becomes possible to increase the toner supply efficiency into the development device 11.

In addition, the embodiment is configured that, when the conveying screw 23 is normally rotated under a condition in which the conveying screw 23 is held at the first position, since the guided piece 73 is moved along the guiding rib 40, the conveying screw 23 is moved from the first position side to the second position side. By applying such a configuration, it becomes possible to move the conveying screw 23 from the first position side to the second position side by using a simple structure.

Further, when the attachment member 22 is reversely rotated under a condition in which the conveying screw 23 is positioned at the first position, the first pressing portion 60 presses the first pressed portion 75 and, thus, the conveying screw 23 is reversely rotated together with the attachment member 22. On the other hand, when the attachment member 22 is reversely rotated under a condition in which the conveying screw 23 is positioned at the second position, the inclined portion 61 presses the first pressed portion 75 and then the second attachment body 48 is moved to a side spaced away from the conveying screw 23 against the biasing force of the coil spring 50. As the result, the attachment member 22 runs idle. By applying such a configuration, under a condition in which the conveying screw 23 is positioned at the first position, it becomes possible to rotate the conveying screw 23 reversely. In addition, under a condition in which the conveying screw 23 is positioned at the second position, it becomes possible to restrict the reverse rotation of the conveying screw 23.

Furthermore, the conveying screw 23 is provided with the connecting body 65 which is provided at the back end of the screw main body 64 (one end of the direction of the rotation axis Z) and connected to the attachment member 22. Accordingly, it becomes possible to connect the attachment member 22 to the conveying screw 23 surely.

Furthermore, since the discharge port 28 is provided across the container part 26 and the duct part 27, it becomes possible to prevent the toner container 15 from being filled with the toner when the conveying screw 23 is normally rotated.

Although a case in which the discharge port 28 is provided across the container part 26 and the duct part 27 is described in the embodiment, in another embodiment, the entire of the discharge port 28 may be provided at the duct part 27.

In the embodiment, a case in which, when the attachment member 22 is reversely rotated under a condition in which the conveying screw 23 is positioned at the second position, the second attachment body 48 is moved to a side spaced away from the conveying screw 23 is described. However, in another different embodiment, when the attachment member 22 is reversely rotated under a condition in which the conveying screw 23 is positioned at the second position, the conveying screw 23 may be moved to a side spaced away from the second attachment body 48.

In the embodiment, for convenient distinction, the clockwise direction in the front view is defined as the normal rotation direction and the counterclockwise direction in the front view is defined as the reverse rotation direction. Accordingly, in another different embodiment, in contrary to the distinction, the counterclockwise direction in the front view may be defined as the normal rotation direction and the clockwise direction in the front view may be defined as the reverse rotation direction. And, based on another view, such as back view, side view, plan view and bottom view, except the front view, the normal rotation direction and the reverse rotation direction may be defined.

In the embodiment, although the configuration of the present disclosure is applied to the toner container 15, in another different embodiments, the configuration of the present disclosure may be applied to a toner case (what is called an "intermediate hopper") arranged between the toner container 15 and the development device 11.

Although the embodiment was described in a case where configurations of the disclosure are applied into the color printer 1, in another different embodiment, the configurations of the disclosure may be applied into another image forming apparatus, such as a monochrome printer, a copying machine, a facsimile, multifunctional peripheral or the like.

While the present disclosure has been described with reference to the particular illustrative embodiments, it is not to be restricted by the embodiments. It is to be appreciated that those skilled in the art can change or modify the embodiments without departing from the scope and spirit3of the present disclosure.

What is claimed is:

1. A toner case comprising:

a case main body having a discharge port configured to discharge a toner;

an attachment member provided at the case main body to be rotatable in normal and reverse rotation directions around a rotation axis; and a conveying member provided at the case main body to be rotatable in the normal and reverse rotation directions around the rotation axis and connected to the attachment member, wherein the conveying member conveys the toner from the inside of the case main body to a side of the discharge port when the conveying member is normally rotated and the conveying member conveys the toner from the side of the discharge port to the inside of the case main body when the conveying member is reversely rotated, and the conveying member is movable in a direction of the rotation axis between a first position in which the conveying member is reversely rotated together with the attachment member when the attachment member is reversely rotated and a second position in which the conveying member makes the attachment member run idle when the attachment member is reversely rotated, wherein the attachment member includes a first attachment body restricted from the movement in the rotation axial direction; and a second attachment body arranged between the first attachment body and the conveying member under a movable condition in the rotation axial direction and biased toward the conveying member side by a biasing body, the second attachment body has a pressing portion provided along the rotation axial direction; and an inclined portion provided contiguously to the pressing portion and inclined relative to the rotation axial direction, the conveying member has a pressed portion provided along the rotation axial direction, when the attachment member is reversely rotated under a condition in which the conveying member is positioned at the first position, the pressing portion presses the pressed portion so that the conveying member is reversely rotated together with the attachment member, and when the attachment member is reversely rotated under a condition in which the conveying member is positioned at the second position, the inclined portion presses the pressed portion so that the second attachment body is moved to a side spaced away from the conveying member against the biasing force of the biasing body and the attachment member runs idle.

2. The toner case according to claim 1, further comprising:

a biasing member configured to bias the conveying member to the second position; and a coupling piece coupling the attachment member to the conveying member and holding the conveying member at the first position against the biasing force of the biasing member, wherein, when the conveying member is normally rotated under a condition in which the conveying member is held at the first position, the conveying member is moved from the first position side to the second position side to break the coupling piece so that the conveying member is held at the second position by the biasing force of the biasing member.

3. The toner case according to claim 2, wherein, on the inner circumference face of the case main body, a guiding rib is projected so as to be inclined from the first position side to the second position side toward a direction in which the conveying member is normally rotated, on the outer circumference face of the conveying member, a guided piece is projected, when the conveying member is normally rotated under a condition in which the conveying member is held at the first position, the guided piece is moved along the guiding rib so that the conveying member is moved from the first position side to the second position side.

4. The toner case according to claim 2, wherein a plurality of coupling pieces are arranged at intervals in the circumferential direction and the coupling pieces extend in the rotation axial direction.

5. The toner case according to claim 1, wherein the first attachment body has a projection portion, and the second attachment body has a hole portion, the projection portion is engaged with the hole portion so that the relative rotation of the second attachment member to the first attachment body is restricted.

6. The toner case according to claim 5, wherein a plurality of projection portions and hole portions are arranged at intervals in the circumferential direction.

7. The toner case according to claim 1, wherein the conveying member includes a conveying member main body extending in the rotation axial direction; and a connecting body provided at one end of the conveying member main body in the rotation axial direction and connected to the attachment member.

8. The toner case according to claim 1, wherein the case main body includes a duct part projecting from one end of the container part in the rotation axial direction, the discharge port is provided at the duct part or across the container part and the duct part.

9. An image forming apparatus comprising:

a toner case which includes:

a case main body having a container part containing a toner and a discharge port configured to discharge the toner so that the toner is supplied to a development device;

an attachment member provided at the case main body to be rotatable in normal and reverse rotation directions around a rotation axis; and a conveying member provided at the case main body to be rotatable in the normal and reverse rotation directions around the rotation axis and connected to the attachment member, wherein the conveying member conveys the toner from the inside of the container part of the case main body to a side of the discharge port when the conveying member is normally rotated and the conveying member conveys the toner from the side of the discharge port to the inside of the container part of the case main body so that the container part is filled with the toner when the conveying member is reversely rotated, and the conveying member is movable in a direction of the rotation axis between a first position in which the conveying member is reversely rotated together with the attachment member when the attachment member is reversely rotated and a second position in which the conveying member makes the attachment member run idle when the attachment member is reversely rotated, wherein the attachment member includes a first attachment body restricted from the movement in the rotation axial direction; and a second attachment body arranged between the first attachment body and the conveying member under a movable condition in the rotation axial direction and biased toward the conveying member side by a biasing body, the second attachment body has a pressing portion provided along the rotation axial direction; and an inclined portion provided contiguously to the pressing portion and inclined relative to the rotation axial direction, the conveying member has a pressed portion provided along the rotation axial direction, when the attachment member is reversely rotated under a condition in which the conveying member is positioned at the first position, the pressing portion presses the pressed portion so that the conveying member is reversely rotated together with the attachment member, and when the attachment member is reversely rotated under a condition in which the conveying member is positioned at the second position, the inclined portion presses the pressed portion so that the second attachment body is moved to a side spaced away from the conveying member against the biasing force of the biasing body and the attachment member runs idle.

10. The image forming apparatus according to claim 9, wherein the toner case further includes a biasing member configured to bias the conveying member to the second position; and a coupling piece coupling the attachment member to the conveying member and holding the conveying member at the first position against the biasing force of the biasing member, when the conveying member is normally rotated under a condition in which the conveying member is held at the first position, the conveying member is moved from the first position side to the second position side to break the coupling piece so that the conveying member is held at the second position by the biasing force of the biasing member.

11. The image forming apparatus according to claim 10, wherein, on the inner circumference face of the case main body, a guiding rib is projected so as to be inclined from the first position side to the second position side toward a direction in which the conveying member is normally rotated, on the outer circumference face of the conveying member, a guided piece is projected, when the conveying member is normally rotated under a condition in which the conveying member is held at the first position, the guided piece is moved along the guiding rib so that the conveying member is moved from the first position side to the second position side.

12. The image forming apparatus according to claim 10, wherein a plurality of coupling pieces are arranged at intervals in the circumferential direction and the coupling pieces extend in the rotation axial direction.

13. The image forming apparatus according to claim 9, wherein the first attachment body has a projection portion, and the second attachment body has a hole portion, the projection portion is engaged with the hole portion so that the relative rotation of the second attachment member to the first attachment body is restricted.

14. The image forming apparatus according to claim 13, wherein a plurality of projection portions and hole portions are arranged at intervals in the circumferential direction.

15. The image forming apparatus according to claim 9, wherein the conveying member includes a conveying member main body extending in the rotation axial direction; and a connecting body provided at one end of the conveying member main body in the rotation axial direction and connected to the attachment member.

16. The image forming apparatus according to claim 9, wherein the case main body includes a duct part projecting from one end of the container part in the rotation axial direction, the discharge port is provided at the duct part or across the container part and the duct part.

* * * * *